US009393467B2

(12) United States Patent
Kitagawa et al.

(10) Patent No.: US 9,393,467 B2
(45) Date of Patent: Jul. 19, 2016

(54) IRON TYPE GOLF CLUB HEAD

(71) Applicant: Bridgestone Sports Co., Ltd., Tokyo (JP)

(72) Inventors: Tomonori Kitagawa, Tokyo (JP); Kozue Wada, Tokyo (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 125 days.

(21) Appl. No.: 14/327,904

(22) Filed: Jul. 10, 2014

(65) Prior Publication Data

US 2015/0024869 A1 Jan. 22, 2015

(30) Foreign Application Priority Data

Jul. 17, 2013 (JP) ..... 2013-148636

(51) Int. Cl.
*A63B 53/04* (2015.01)

(52) U.S. Cl.
CPC ..... *A63B 53/047* (2013.01); *A63B 2053/0408* (2013.01); *A63B 2053/0433* (2013.01); *A63B 2053/0445* (2013.01); *A63B 2053/0458* (2013.01)

(58) Field of Classification Search
CPC ..... A63B 53/047; A63B 2053/0458; A63B 2053/0433; A63B 2053/0408
USPC ..... 473/324–350, 287–292
See application file for complete search history.

(56) References Cited

U.S. PATENT DOCUMENTS 3,079,157 A * 2/1963 Turner ..... A63B 53/04 473/328
5,377,978 A * 1/1995 Lee ..... A63B 53/00 473/291
5,437,456 A * 8/1995 Schmidt ..... A63B 53/04 473/290
5,842,934 A * 12/1998 Ezaki ..... A63B 53/04 473/290
7,022,028 B2 * 4/2006 Nagai ..... A63B 53/04 473/291
7,131,913 B2 * 11/2006 Iwata ..... A63B 53/04 473/350
8,535,176 B2 * 9/2013 Bazzel ..... A63B 53/047 473/290
8,801,540 B2 * 8/2014 Hebreo ..... A63B 53/06 473/329
8,882,608 B2 * 11/2014 Sukman ..... A63B 53/047 473/329
2004/0092331 A1 5/2004 Best (Continued)

FOREIGN PATENT DOCUMENTS

JP 2003-62134 A 3/2003
JP 2006-305170 A 11/2006

(Continued)

*Primary Examiner* — Sebastiano Passaniti
(74) *Attorney, Agent, or Firm* — Muncy, Geissler, Olds & Lowe, P.C.

(57) ABSTRACT

An iron type golf club head that comprises a face part, a sole part, a hosel part, and a cavity part. A lower part of an inner surface of the cavity part on a face surface side is a forward recess part that is recessed toward a face surface, and following formulas are satisfied:

$\theta_2 \leq \theta_3$ and $\theta_2 \leq \theta_1$ wherein an intersectional angle that is formed between the lower part of the inner surface of the cavity part on the face surface side and the face surface is marked with $\theta_2$, an intersectional angle that is formed between a rear surface of the cavity part and the face surface is marked with $\theta_3$, and an intersectional angle that is formed between a bottom surface of the cavity part and the face surface is marked with $\theta_1$.

11 Claims, 3 Drawing Sheets

(56) References Cited

U.S. PATENT DOCUMENTS

2006/0166758 A1* 7/2006 Roberts ..... A63B 53/047
473/349
2010/0167834 A1* 7/2010 Llewellyn ..... A63B 53/0475
473/291

FOREIGN PATENT DOCUMENTS

JP 2009-56060 A 3/2009
JP 2009-82291 A 4/2009

* cited by examiner

IRON TYPE GOLF CLUB HEAD

CROSS REFERENCE TO RELATED APPLICATION

The present application is related to, claims priority from and incorporates by reference Japanese Patent Application No. 2013-148636, filed on Jul. 17, 2013.

TECHNICAL FIELD

A present invention relates to an iron type golf club head, and specifically relates to an iron type golf club that has a forward recess part in a lower part of an inner surface of a cavity part on a face surface side, the forward recess part being recessed toward the face surface of the golf club head.

BACKGROUND

As an iron type golf club, there are iron clubs mainly used for shots in a fairway, a rough, a bunker, and the like, as well as a tee shot in a short hole (par 3 hole) and the like. Also there are utility clubs that have a head whose shape is similar to the shape of an iron head.

In the iron head, a portion from a face part to a hosel part that is made of a stainless steel, a carbon steel, various alloys, or the like is widely used.

The iron head has a face surface that hits a ball and a sole surface that faces the ground. The hosel part is provided on a heel side of the head. A shaft is inserted into the hosel part and firmly adhered by a firmly adhering method such as adhesive agent.

An iron type golf club head that has a projection part that is a shape in which a sole side of the head is protruded rearward has a gravity center that is low, and a distance (gravity center depth) from a face surface of the head to the gravity center that is long. The iron type golf club head having such a projection part tends to be preferred by powerless players.

In Patent documents 1 and 2, an iron head is disclosed that has a recess part in a crossing corner part of an upper surface of a sole part and a reverse surface of a face part, the recess part being recessed toward a face surface.

Patent Documents

Patent document 1: JP Laid-Open Patent Application No. 2003-62134

Patent document 2: US Patent Application Publication No. 2004/0092331

Patent document 3: JP Laid-Open Patent Application No. 2006-305170

Patent document 4: JP Laid-Open Patent Application No. 2009-56060

Patent document 5: JP Laid-Open Patent Application No. 2009-82291

SUMMARY

The iron head in Patent document 1 comprises a thick part in a center and its vicinity of the reverse surface of the face part. However, the crossing corner part between the reverse surface of the face part and the upper surface of the sole part is not formed thin. Patent document 2 discloses a recess part to which a polymer material is added.

The present invention is objected to provide an iron type golf club head that comprises a face part that is more likely to be deflect when the face part hits a ball, a superior ball rebound property, and a superior manufacturability.

An iron type golf club head disclosed in the application that comprises a face part, a sole part, a hosel part, and a cavity part. A lower part of an inner surface of the cavity part on a face surface side is a forward recess part that is recessed toward a face surface, and following formulas are satisfied:

$$\theta_2 \leq \theta_3 \text{ and } \theta_2 \leq \theta_1$$

wherein an intersectional angle that is formed between the lower part of the inner surface of the cavity part on the face surface side and the face surface is marked with $\theta_2$, an intersectional angle that is formed between a rear surface of the cavity part and the face surface is marked with $\theta_3$, and an intersectional angle that is formed between a bottom surface of the cavity part and the face surface is marked with $\theta_1$.

In the iron head according to the present invention, the cavity part is provided on a reverse surface side of the face part, and the forward recess part is provided that is recessed toward the face surface in the lower part of the inner surface of the cavity part on the face surface side. Therefore, larger deflecting of the face part at the time of hitting a golf ball is realized so that a faster initial speed of ball and/or a longer carry are obtained.

DETAILED DESCRIPTION OF EMBODIMENT

Figure 1:
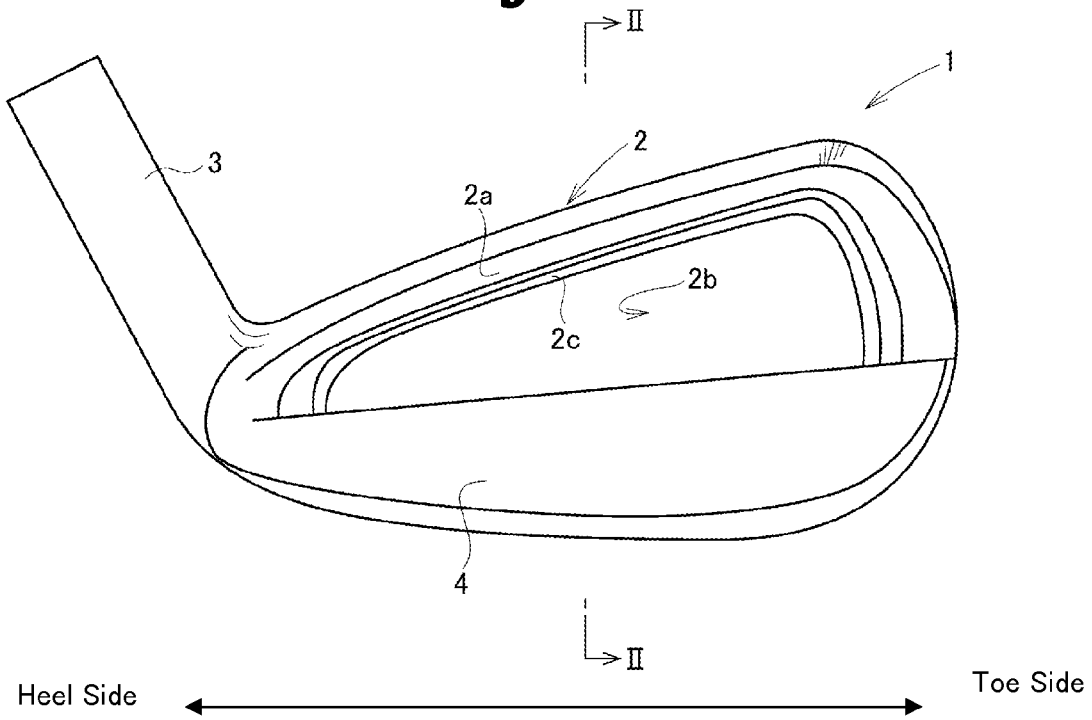
FIG. 1 is a reverse surface view of an iron type golf club head according to an embodiment.

An embodiment is explained as referring to FIGS. 1-4.

An iron head 1 has a face part 2, a hosel part 3 that is connected to a heel side of the face part 2, and a sole part 4 that is connected to a lower part of the face part 2. In the hosel part 3, a hosel hole (not illustrated) into which a shaft is inserted is provided. A front surface of the face part 2 is a face surface 2*f*, and many score lines (or grooves, not illustrated) are provided.

In a peripheral part of a reverse surface of the face part 2, a projection part 2*a* is provided on a toe side, a top side, and a heel side of the peripheral part. The projection part 2*a* has a thickness $t_4$ shown in FIG. 2, which surrounds a cavity part 5 on a top side. A part of the reverse surface that is in the center and its vicinity of the face part is a back surface 2*b*. Between peripheries of the back surface 2*b* and the projection part 2*a*, a high stage part 2*c* which is positioned higher than the back surface 2*b* is provided. A thickness of the face part at the high stage part 2*c* is greater than a thickness of the face part at the center part. Herein, the face part at the center part indicates a center part of the face surface 2*f*. The back surface 2*b*, the high stage part 2*c* and the projection part 2*a* are continued sections having different thicknesses $t_1$, $t_2$, $t_4$. These sections may be connected in a smooth manner (or the thinness changes gradually) or in a stepping manner (or each section having certain thinness differing from other sections).

Figure 2:
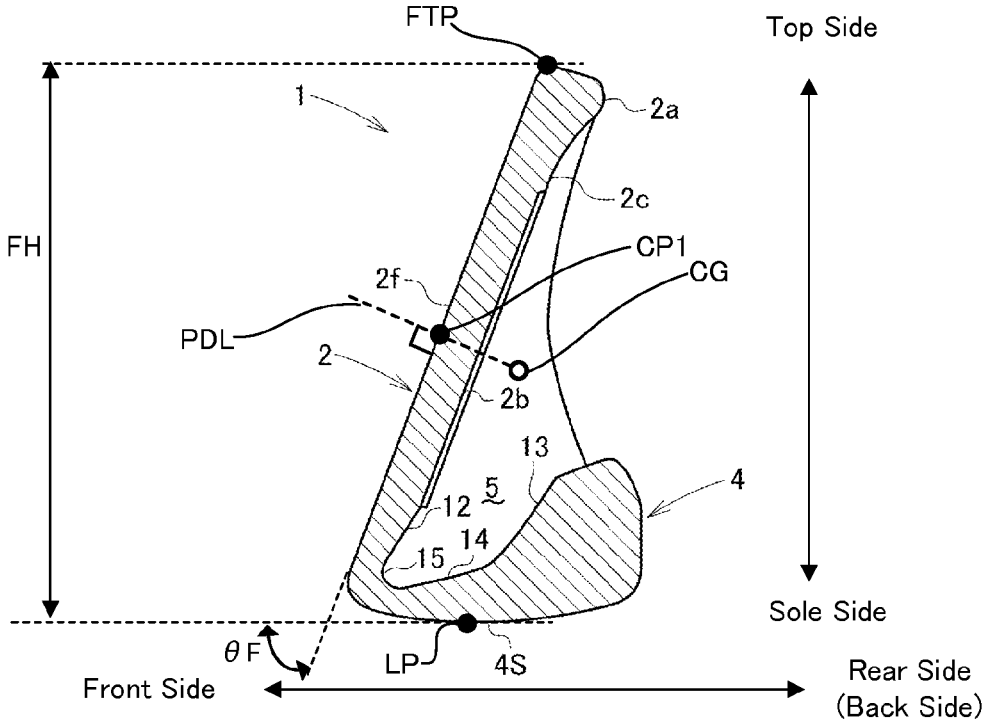
FIG. 2 is a cross sectional view taken along II-II line in FIG. 1, which is a toe-heel view at the middle section.

More specifically, the center part of the face surface 2*f* is defined in the several ways in the present invention. For one example, the center part CP1 is defined at an emerging point on the face surface 2*f* that is determined with a perpendicular line PDL from the gravity point CG of the head 1 toward the face surface 2*f*. The center point CP1 is illustrated in FIG. 2. For another example, the center part CP2 is defined by middle points of a face height FH and a score line width SLW. The center point CP2 is measured under a condition that the head 1 is addressed with a regulated lie angle θL and regulated loft angle θF. The face height FH is defined as the largest vertical height of the head 1 and measured from the ground line GL to the highest point FTP of the head 1. The ground line GL is determined as a toe-heel direction line that passes through a lowest point LP of the sole 4. The lowest point LP may be determined as a point where the sole surface 4S touches the ground when the head is addressed. The center part CP2 and a toe-heel direction line FHL passing through the center part CP2 divide the face height FH into halves in the top-sole direction. The score line width SLW means the largest length of the score line on the face surface 2*f*. The center point CP2 and a top-sole direction line SCL passing though the center part CP2 divide the score line width SLW into halves in the toe-heel direction. The center point CP2 may be defined as an intersectional point between a half of the face height FH and a half of the score line width SLW.

The sole part 4 is extended from a toe side to a heel side of the iron head 1. A bottom surface of the sole part 4 is a sole surface 4*s*.

In a reverse surface side of the face part, the cavity part 5 is provided. The cavity part is extended from the toe side to the heel side, and its periphery of the cavity part is surrounded by the sole part and the projection part 2*a*.

In an inner surface of the cavity part 5 a surface on the face part 2 side (for example, 12) is connected to the back surface 2*b*, and a front surface 12 is provided that approaches the face surface as it goes down so that the thickness becomes thinner at it lowers. In the inner surface of the cavity part, a rear surface 13 is shaped lowering from an upper surface of the sole part 4 and inclines as approaching the face surface as it goes down. A bottom surface 14 of the cavity part is connected to the rear surface 13, and is extended toward the face surface. The bottom surface 14 inclines as approaching the sole surface 4*s* as it goes forward. A crossing corner part formed between the bottom surface 14 and the front surface 12 is a curved recess surface 15 that is rounded. The front surface 12 and a front part of the curved recess surface 15 connected thereto form a forward recess.

A length of the front recess part in a toe-heel direction is 20 mm or more, and preferably 30 mm or more, for a lower limit. When the length is less than 20 mm, the face part 2 may not sufficiently deflect at the time of hitting a ball. For an upper limit, the length is 70 mm or less, preferably 60 mm or less. When the length is more than 70 mm, durability of the head 1 may be deteriorated.

Figure 3:
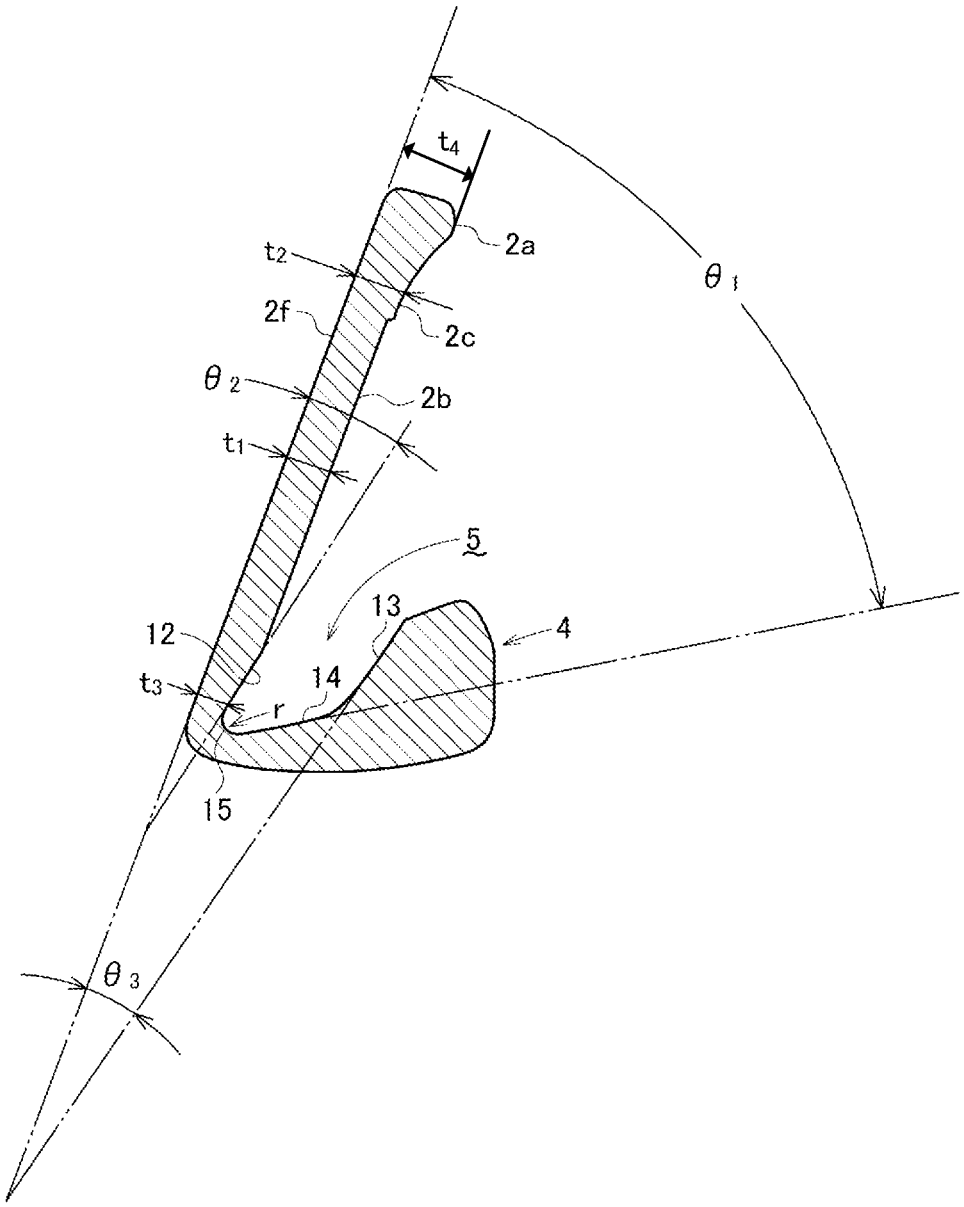
FIG. 3 is an end view taken along II-II line in FIG. 1, which is a toe-heel view at the middle section.
Figure 4:
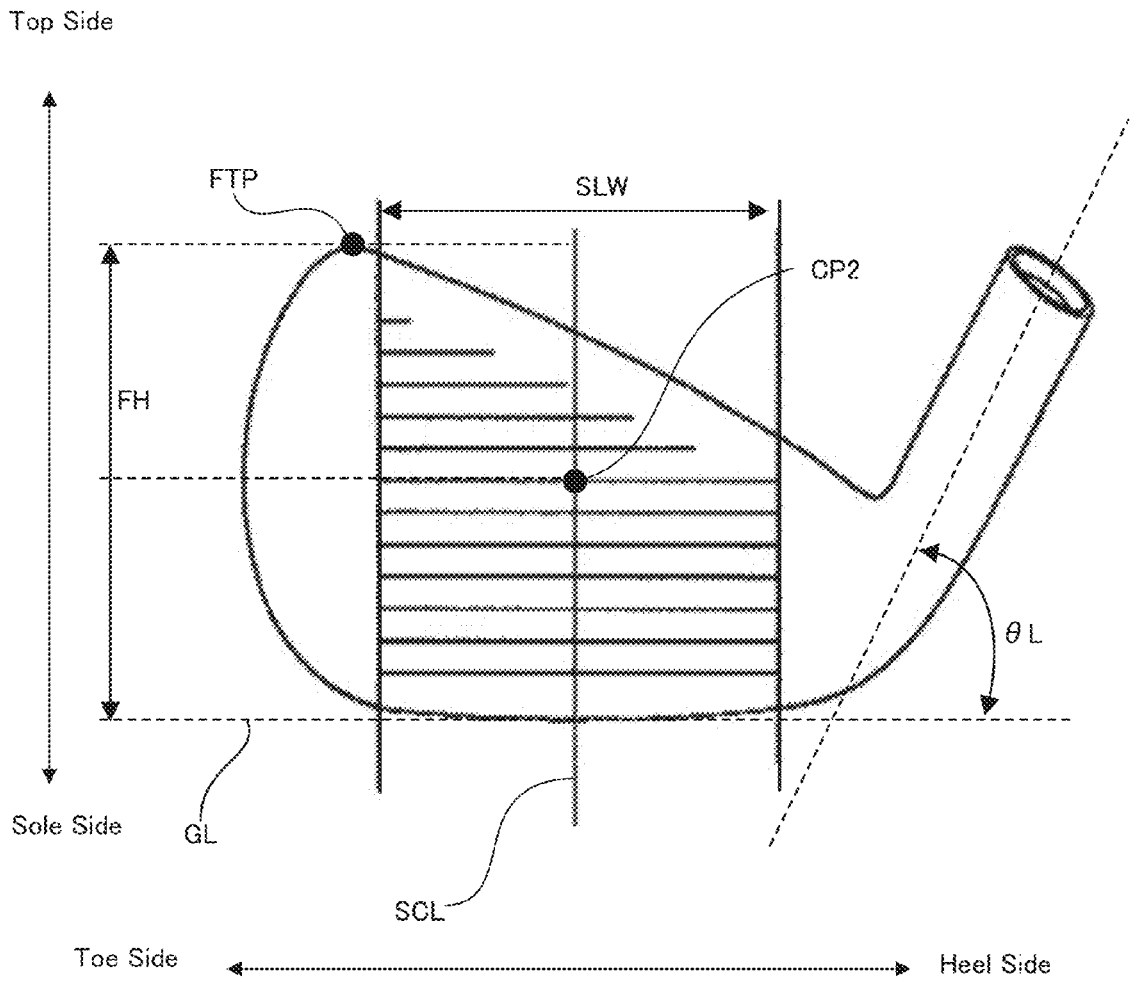
FIG. 4 is a front view that illustrates a face of the club that is addressed with regulated lie and loft angles.

The front surface 12 approaches the face surface 2*f* as it goes down as described above. Or, the lower part of the front surface 12 is closer to the face surface 2*f* rather than the upper part of the front surface 12 is. FIG. 3 is a right side end view that is seen from the toe-heel direction in a state where the face surface, which is seen from the front side, is defined as a front view. As illustrated in FIG. 3, an intersectional angle $\theta_2$ that is formed between the front surface 12 and the face surface 2*f* is 5° or more, preferably 10° or more, for a lower limit. When $\theta_2$ is less than 5°, the face part 2 may not sufficiently deflect at the time of hitting a ball. For an upper limit, the intersectional angle is 30° or less, preferably 25° or less. When the intersectional angle is more than 30°, durability may be deteriorated.

An intersectional angle $\theta_3$ that is formed between the rear surface 13 and the face surface 2*f* is set to be $\theta_2 \leq \theta_3$. The intersectional angle $\theta_3$ is 80° or less, preferably 40° or less, for a lower limit.

An intersectional angle $\theta_1$ that is formed between the bottom surface 14 and the face surface 2*f* is set to be $\theta_2 \leq \theta_1$. The intersectional angle $\theta_1$ is 90° or less, preferably 75° or less, for a lower limit. When the intersectional angle $\theta_1$ is more than 90°, durability of the head 1 may be deteriorated.

A curvature radius r of the curved recess surface 15 is 0.5-3.0 mm, specifically preferably 0.7-2.5 mm. When the curvature radius r is less than 0.5 mm, durability of the head 1 may be deteriorated. When the curvature radius r is more than 3.0 mm, a thickness of a sole side is too small, resulting in that the durability may be deteriorated.

Note, when $\theta_1$-$\theta_3$ are set as described above, cores (or casting cores) for forming the cavity part can be easily removed in casting of the head 1 so that superior manufacturability is obtained. Also, a part of the cavity part surrounded by the surface of the inner surface of the cavity part on the face part side, the bottom surface 14, and the rear surface 13 may also be made larger. As a result, rigidity of the sole part is decreased and a structure in which the face part is able to deflect more can be obtained.

A thickness of a sole that is a part whose thickness from the bottom surface 14 to the sole surface is smallest is 1.5-5.0 mm, specifically preferably approximately 2.0-4.0 mm.

A thickness of the face part 2 in the center part of the face part is marked with $t_1$. A thickness of the face part 2 on a top side of the high stage part 2*c* is marked with $t_2$. A thickness of a part of the face part 2 in the forward recess part, the part having the smallest thickness of the face part 2, is marked with $t_3$. When $t_2 \geq t_1$, rigidity of an upper part of the head becomes higher, so that a deflecting effect of the face part 2 at the time of hitting a ball due to the forward recess part becomes higher.

Further more, it is preferred that the thicknesses t1, t2 and the thickness $t_4$ of the projection part 2*a* satisfy the following formula:

$$t_4 > t_2 \geq t_1$$

Thereby, an effective deflection and durability for hitting impact on the top side is well balanced.

For a lower limit, $t_3/t_1$ is 0.5 or more, and preferably 0.6 or more. When $t_3/t_1$ is less than 0.5, the durability of the head 1 may be deteriorated. For an upper limit, $t_3/t_1$ is 0.9 or less, preferably 0.8 or less. When $t_3/t_1$ is more than 0.9, the face part 2 may not sufficiently deflect at the time of hitting a ball.

A material of the head 1 is not specifically limited as long as it is made of a metallic material. A material of the face part 2 is preferably a material whose Young's modulus is 70-230 GPa, such as stainless steel, soft iron, titanium alloy, and soft stainless steel. When the Young's modulus is less than 70 GPa, the durability of the face part 2 may be deteriorated, and when it is more than 230 GPa, the face part 2 may not sufficiently deflect at the time of hitting a ball.

With the iron head 1 configured as described above, larger deflecting of the face part 2 at the time of hitting a golf ball, a higher ball rebound property, a faster initial speed of ball, and a longer carry can be obtained. Also, with the iron head 1, the core can be easily removed at the time of casting so that a superior manufacturability is obtained.

The above-described embodiment is one example of the present invention, and the present invention may be embodied in another embodiment that is different from one shown in the drawings. The present invention is applicable to an iron type utility head whose external shape is similar to the one of the iron head.

EXAMPLES

Iron head models of Example 1 and Comparative example 1, which are described below, were made, and hitting simulations by computer in the same condition were performed. In the hitting simulations, the iron head models hit a golf ball model at a head speed of 40 m/s. The results are shown in Table 1.

Example 1

An iron head model (4 iron with a loft angle of 22°) of having the configuration shown in FIGS. 1-3 was made. A Young's modulus was set to be 210 GPa. Following lengths were set as follows: $t_1$=3.0 mm; $t_2$=4.0 mm; and $t_3$=2.3 mm. Following angles were set as follows: $\theta_2$=20°, $\theta_3$=20°, and $\theta_1$=60°. A curvature radius r of the curved recess surface 15 was set to be 1.0 mm. A thickness of a sole that is a part whose thickness from a bottom surface to a sole surface is smallest was set to be 2.1 mm

Comparative Example 1

In comparative Example 1, the forward recess part was eliminated from Example 1, and followings were set as follows: $\theta_2$=0; and $t_3$=3.0 mm. Other than those, a head model that had the configuration the same as Example 1 was made.

TABLE 1

| No. | Example 1 | Comparative Example 1 |
|---|---|---|
| $\theta_1$ | 60 | 60 |
| $\theta_2$ | 20 | 0 |
| $\theta_3$ | 20 | 20 |
| Initial Speed (m/s) | v1 = 53.37 | v2 = 53.28 |

As shown in Table 1, it was recognized that an initial speed of ball of Example 1 was 53.37 m/s. An initial speed of Comparative Example 1 was 53.28 m/s. Accordingly, the present invention achieved a faster initial speed with 0.09 m/s than comparative Example 1.

What is claimed is:

1. An iron type golf club head that comprises a face part, a sole part, a hosel part, and a cavity part, wherein a lower part of an inner surface of the cavity part on a face surface side is a forward recess part that is recessed toward a face surface, and the following formulas are satisfied:

$$\theta 2 \leq \theta 3 \text{ and } \theta 2 \leq \theta 1,$$

wherein an intersectional angle that is formed between the lower part of the inner surface of the cavity part on the face surface side and the face surface is marked with θ2, an intersectional angle that is formed between a rear surface of the cavity part and the face surface is marked with θ3, and an intersectional angle that is formed between a bottom surface of the cavity part and the face surface is marked with θ1, the bottom surface of the cavity part, which forms the intersectional angle (θ1), inclines such that the bottom surface approaches a sole surface of the sole part as the bottom surface approaches the face part, and the intersectional angle (θ1) is 90° or less.

2. The iron type golf club head according to claim 1, wherein when a thickness of the face part in a center part of the face part is marked with t1, a thickness of a projection part that surrounds the cavity part on a top side thereof and is thicker than the center part is marked with t4, and a thickness of a high stage part that is positioned between the projection part and the center part is marked with t2, the following formula is satisfied:

$$t4 > t2 \geq t1.$$

3. The iron type golf club head according to claim 2, wherein the center part of the face part is a point (CP1) where a perpendicular line, which is drawn from a gravity center of the club head toward a face surface, emerges on the face surface.

4. The iron type golf club head according to claim 2, wherein the center part of the face part is a point (CP2) that is determined by crossing two lines, the two lines being defined:

under a condition where the club head is addressed with regulated lie and loft angles, one of the lines is a top-sole direction line (SCL) which divides a longest score line of the face part into halves in a toe-heel direction, and the other of the lines is a toe-heel direction line (FHL) which divides a face height that is the largest length of the club head in the top-sole direction from a ground line.

5. The iron type golf club head according to claim 1, wherein when a thickness of a part of the face part in the forward recess part, the part comprising the smallest thickness of the face part, is marked with t3, the following formula is satisfied:

$$0.5 \leq t3/t1 \leq 0.9.$$

6. The iron type golf club head according to claim 1, wherein a crossing corner part that is formed between the forward recess part and the bottom surface of the cavity part is a curved recess surface, and a curvature radius of the curved recess surface on a vertical cross section in a front-rear direction of the iron type golf club head ranges within 0.5-3.0 mm.

7. The iron type golf club head according to claim 1, wherein a length of the forward recess part in a toe-heel direction is 20 mm or more and 70 mm or less.

8. The iron type golf club head according to claim 1, wherein the intersectional angle (θ2) is 5° or more and 30° or less.

9. The iron type golf club head according to claim 1, wherein the intersectional angle (θ3) is 80° or less.

10. The iron type golf club head according to claim 1, wherein a smallest thickness of the sole part, which is defined by a smallest length between the bottom surface of the cavity part and the sole surface of the sole part, is ranged between 1.5-5.0 MM.

11. The iron type golf club head according to claim 1, wherein

Young's modulus of a material forming the face part is ranged between 70-230 GPa.

* * * * *